United States Patent [19]

Shaw

[11] Patent Number: 4,924,917

[45] Date of Patent: May 15, 1990

[54] WEFT THREAD BREAK MONITOR AND MOVEMENT LIMITING DEVICE

[75] Inventor: Henry Shaw, Woesten-Vleteren, Belgium

[73] Assignee: Picanol N.V., Belgium

[21] Appl. No.: 323,997

[22] Filed: Mar. 16, 1989

[30] Foreign Application Priority Data

Mar. 16, 1988 [BE] Belgium ..... 8800299

[51] Int. Cl.[5] ..... D03D 47/36; D03D 51/34

[52] U.S. Cl. ..... 139/452; 139/370.2

[58] Field of Search ..... 139/370.2, 452, 116 A, 139/450, 435

[56] References Cited

U.S. PATENT DOCUMENTS

| | | | |
|---|---|---|---|
| 3,282,303 | 11/1966 | Ancet et al. | 139/370 |
| 4,215,728 | 8/1980 | Weidman et al. | 139/370.2 |
| 4,372,349 | 2/1983 | Van Mullekom | 139/452 |
| 4,556,088 | 12/1985 | Tanaka et al. | 139/370.2 |
| 4,617,971 | 10/1986 | Hellstroem | 139/370.2 |
| 4,792,101 | 12/1988 | Van Bogaert et al. | 139/452 X |

FOREIGN PATENT DOCUMENTS

| | | |
|---|---|---|
| 905312 | 2/1987 | Belgium . |
| 0195469 | 9/1986 | European Pat. Off. . |

*Primary Examiner*—Andrew M. Falik

*Attorney, Agent, or Firm*—Bacon & Thomas

[57] ABSTRACT

A weaving machine is of the type in which the weft thread remains attached to the edge of the cloth between successive picks, the weft thread moving along with the cloth as the weaving process progresses, and in which detection of a thread break causes deactivation of a corresponding thread preparation mechanism and transfer of its task to another thread preparation mechanism. The weaving machine includes a monitoring device which, in the case of a thread break, sets a limit as to how much further the broken section of weft thread which is attached to the cloth can move. The monitoring device supplies an output signal so that further action can be taken to prevent further movement of the broken weft thread along with the cloth.

12 Claims, 4 Drawing Sheets

WEFT THREAD BREAK MONITOR AND MOVEMENT LIMITING DEVICE

BACKGROUND OF THE INVENTION

This invention concerns weaving machines with an improved weft thread supply, more particularly weaving machines of the type in which each weft thread remains attached to the edge of the cloth between successive picks, as for example on rapier weaving machines.

It is known that the weft thread supply on certain types of weaving machines, such as rapier machines, includes one thread preparation mechanism for each type of weft thread, plus a thread presentation mechanism for presenting the respective weft threads in the path of a feed gripper. The thread preparation mechanisms each include a thread package, a prewinder mechanism and a thread braking device.

From Belgian patent No. 901.969 it is known for a thread detector to be included in the thread preparation mechanism. The thread detector is connected to the control unit such that whenever a broken weft thread is detected in a corresponding thread preparation mechanism, the machine automatically switches to another thread preparation mechanism, so that weaving can continue.

On rapier weaving machines in which the weft threads are cut loose at the beginning of their insertion after being presented in the path of the feed gripper, and then after insertion remain attached to the thread package back from the cloth edge until a new insertion of the corresponding weft thread occurs, the abovementioned method of automatically switching between thread preparation mechanism poses a problem. On such rapier weaving machines, the weft threads are drawn along with the cloth at a constant, if low, speed. This means that if a thread break occurs in a thread preparation mechanism, the section of thread still attached to the cloth edge is eventually drawn out of the thread preparation mechanism and falls into the path of the rapier. Such a section of weft thread is then carried into the shed along with the next weft thread to be inserted, so that a fault occurs in the cloth, of a type which is difficult to detect by conventional weft detectors.

SUMMARY OF THE INVENTION

It is an object of the invention to provide a solution to the disadvantage just described, by ensuring that, before there can be a fall-off in the thread tension in a broken weft thread between the thread presentation mechanism and the edge of the cloth, an output signal is provided for further processing such that either an alarm is given, the weaving machine is stopped, or an alarm is given followed a certain time later by a machine stop.

The invention concerns a weaving machine with an improved weft thread supply, of the type in which each weft thread remains attached to the edge of the cloth between successive picks. The weft thread supply includes at least two thread preparation mechanisms each of which comprises a thread package, a prewinder and a thread braking device. A thread break detector is mounted somewhere along the path of the weft thread, more particularly between the thread package and the thread braking device, and a thread presentation mechanism is positioned after the thread preparation mechanism. Also included is a control unit connected to the thread preparation mechanisms, the thread presentation mechanism and the thread break detector, such that if the thread break detector detects a thread break, the control unit deactivates the thread preparation mechanism in use and also its corresponding thread guide element of the thread presentation mechanism, after which weaving continues with only one or more of the other thread preparation mechanisms according to a preset pattern. Finally, the improved weft thread supply of the invention includes a monitoring device which, if the thread break detector detects a thread break, sets a limit to how much farther the broken thread still attached to the cloth can move, and which also provides an output signal for further processing, at least at the moment that the limit is reached by the end of the broken section of weft thread. The monitoring device can consist of a delay circuit included in the weaving machine control which, when the thread break detector has detected a break, lets the weaving machine operate further for a known, predetermined length of time and then automatically brings it to a halt.

BRIEF DESCRIPTION OF THE DRAWINGS

In order to better describe the characteristics of the invention, some preferred embodiments are now described, by way of example only and without being limitative in any way, with reference to the accompanying drawings, where.

DETAILED DESCRIPTION OF THE PREFERRED EMBODIMENTS

Figure 1:
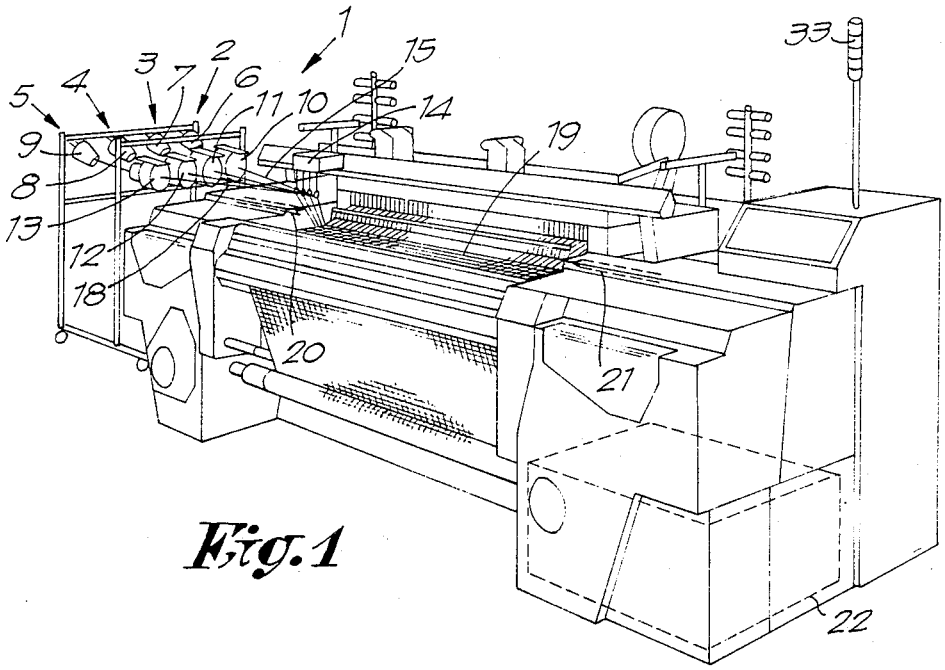
FIG. 1 is a perspective view of a gripper weaving machine with an improved weft thread supply.

FIG. 1 shows a rapier weaving machine in which, as is known, the supply 1 consists of a number of thread preparation mechanisms 2 to 5, each of which consists of a number of thread packages 6 to 9, prewinders 10 to 13 and a thread presentation mechanism 14 for the purpose of bringing the weft threads 15 to 18, which are attached to the cloth 19, into the path of the feed gripper, in order to provide the weft. Also shown schematically in FIG. 1 are the receiving gripper 21 and the main drive 22 of the weaving machine. The supply 1 according to the invention is now described in detail with reference to the block diagram in FIG. 2.

The supply consists of a combination of: the thread preparation mechanisms 2 to 5, each of which consists of at least a thread package 6 to 9, a prewinder 10 to 13 and a thread braking device 23 to 26; at least one thread break detector 27 positioned in the path of the weft thread 15, more particularly between the corresponding thread package 6 and the corresponding thread braking device 23; a thread presentation mechanism 14 positioned after the thread preparation mechanisms 2 to 5; a control unit 28 connected to the thread preparation mechanisms 2 to 5, the thread presentation mechanism 14 and the thread break detector 27; and a monitoring device 29 including means to set a predetermined limit G to how much farther the broken section of weft thread 15A can move when the thread break detector 27 detects a thread break 30. The control unit 28 is designed so that if the thread break detector 27 detects a thread break 30, the thread preparation mechanism 2 in use is deactivated and the corresponding weft thread 15 (15A) is no longer presented by means of the thread guide element 34 of the thread presentation mechanism 14. Instead another thread preparation mechanism 3 to 5, according to choice, is activated instead. Clearly, if weaving is being carried out using all four of the thread preparation mechanism 2 to 5 according to a particular pattern, then when a break occurs this operating pattern is modified so that weaving can continue with only the remaining three thread preparation mechanisms 3 to 5. As already mentioned, the use of such a control unit to switch over to another thread preparation mechanism if a fault is detected is known from Belgian patent No. 901.969 granted to the applicant.

The above-mentioned monitoring device 29 supplies an output signal 31 whenever the free end 32 of the broken section of weft thread 15A has reached the limit G or is considered to have reached this limit. The output signal 31 can then be processed in any desired manner, for example in order to activate an alarm signalling device 33 or to shut off the main drive 22 of the weaving machine.

Figure 2:
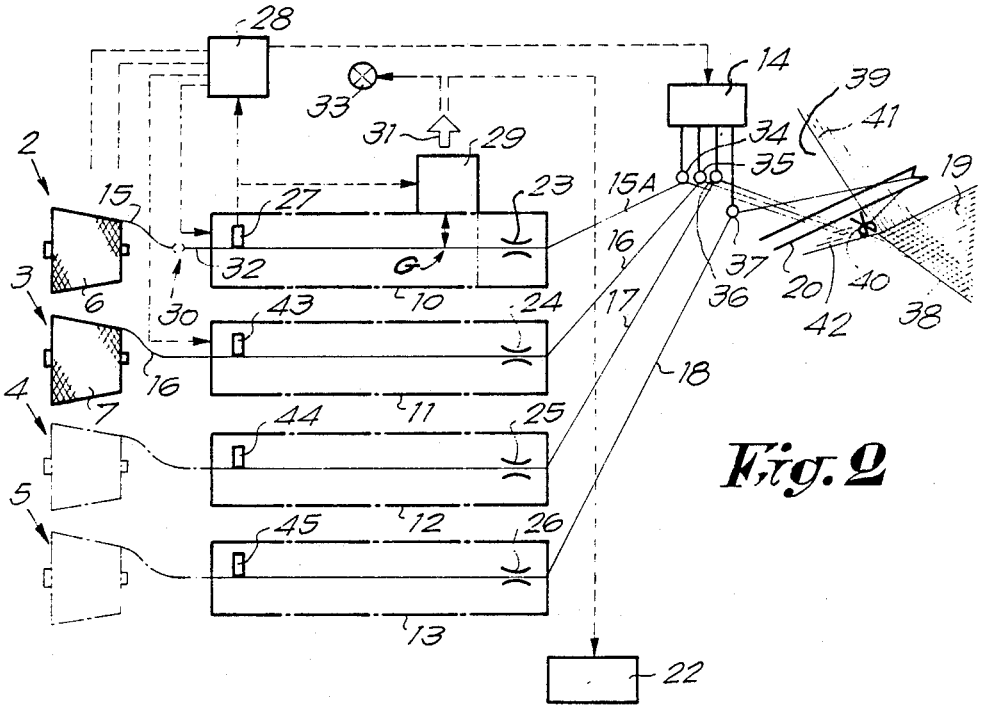
FIG. 2 is a schematic diagram of the improved supply according to the invention, including a schematic partial perspective view of the weft insertion mechanism and shed of the weaving machine of FIG. 1.

The operation and the purpose of the invention can be simply deduced from FIG. 2. During normal operation of the weaving process, as they are led along the thread guide elements 34 to 37 of the thread presentation mechanism 14 which are movable up and down, the weft threads 15 to 18 are kept taut since they remain attached to the edge of the cloth 38 and also pass through the thread braking devices 23 to 26. Since the cloth 19 moves forward continuously, the weft threads 15 to 18 are also continuously moved forward slowly when they are not inserted into the shed 39.

The insertion of the weft threads is itself common technology. As shown schematically in FIG. 2, the required thread guide element 37 is moved down so that the corresponding weft thread 18 is brought into the path of the feed gripper 20 and so carried into the shed 39. At the beginning of the insertion the weft thread 18 is cut free from the cloth edge 38 by a cutter 40. Once the weft thread has been beaten up between the warp threads 41 and 42, it is not cut free again at the weft insertion side until another weft thread of the same weft yarn is inserted.

Should a thread break 30 occur, the operation of the weft supply 1 is as follows. The thread break 30 is detected at a certain moment by the thread break detector 27. By means of the control unit 28 the thread preparation mechanism 2 is deactivated and the thread guide element 34 of the thread presentation mechanism is no longer presented, while another thread preparation mechanism 3, 4 or 5 is activated in its place. Obviously, for this purpose it is possible to use one or more thread preparation mechanisms which were already in use before the weft break occurred; after the thread break, these will then take over the task of the deactivated thread preparation mechanisms 2, in addition to their normal task. Thread presentation will then continue using only the thread guide elements 35 and/or 36 and/or 37. The section of weft thread 15A will however continue to move forward with the cloth. If no special measures are taken in order to carry out a repair, after a certain time the end 32 will come out of the thread braking device 23, so that the section of weft thread 15A will come loose and due to its own weight will sag between the corresponding thread guide element and the edge of the cloth 38 and so come into the path of the feed gripper 20, resulting in the disadvantages mentioned in the Background of the Invention.

In the present invention, however, as a result of the signal from the abovementioned thread break detector 27, the monitoring device 29 is activated, so that said monitoring device supplies an output signal 31 whenever the free end 32 runs through one or more preset limits G. The limits G are situated so that the thread runs through them before it reaches the thread braking device 23. In this way, either the alarm signalling device 33 can be activated or the main drive 22 of the weaving machine can be shut off before the section of weft thread 15A comes loose from the thread braking device 23. In this way, it is possible to intervene manually in good time or to intervene automatically by stopping the weaving machine.

Clearly, in a similar way as for thread preparation mechanism 2, the other thread preparation mechanisms 3 to 5 can also be equipped with thread break detectors 43 to 45 and connected to the monitoring device 29.

Figure 3:
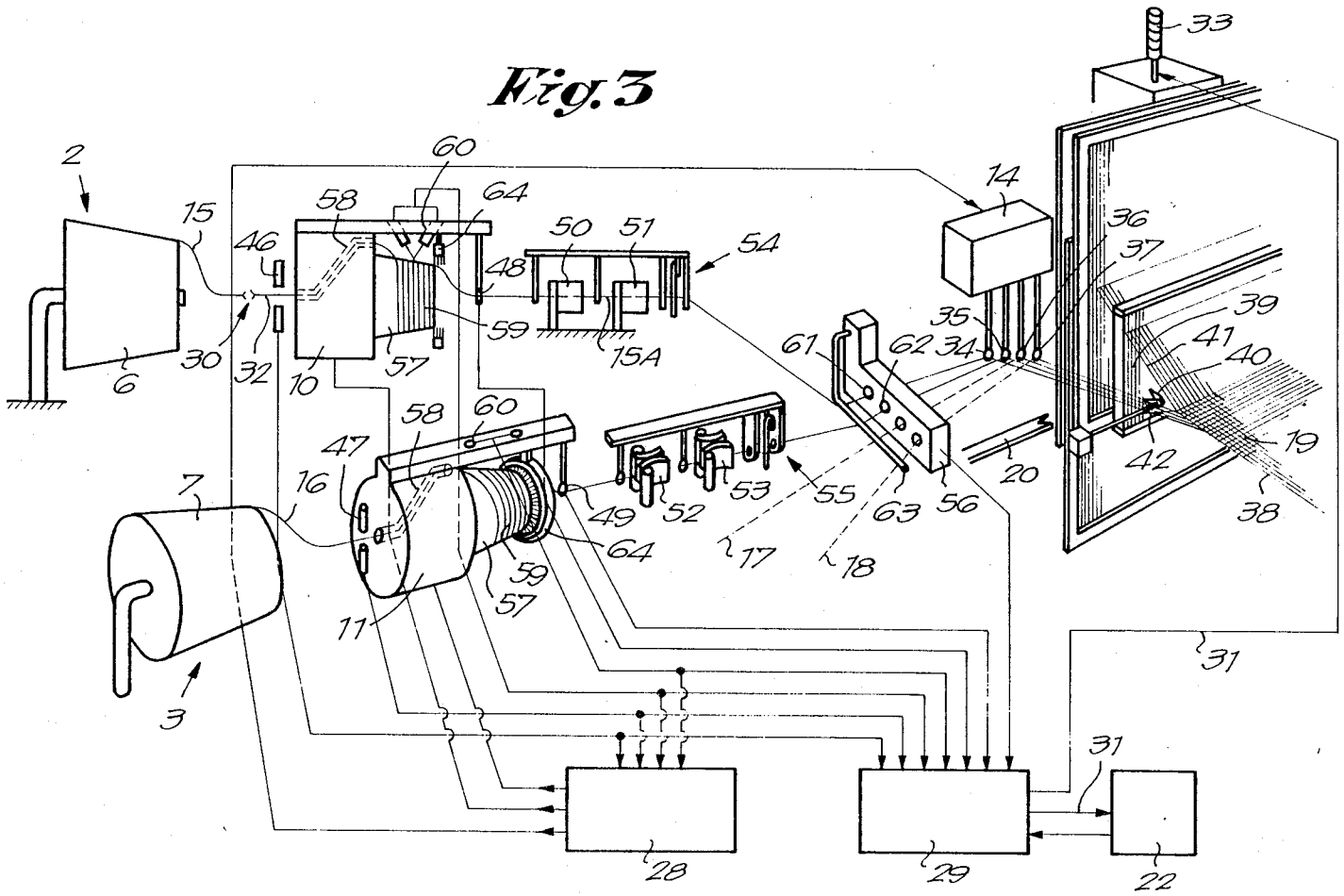
FIG. 3 is a detailed representation of the weft thread supply according to the invention.

FIG. 3 shows a practical embodiment corresponding to the block diagram in FIG. 2, more particularly for two thread preparation mechanisms 2 and 3. In this configuration, the weft threads 15 and 16 pass successively and respectively through the detectors 46 and 47, the prewinders 10 and 11, the detectors 48 and 49, the thread brakes 50, 51 and 52, 53, thread compensators 54 and 55, a weft detector 56 and the thread guide elements 34 and 35 of the thread presentation mechanism 14.

The prewinders 10 and 11 each consist of a prewinder drum 57 and a rotating winding tube 58 through which the turns 59 are wound onto the prewinder drum. The prewinders each have one or more turn detectors 60 which monitor the quantity of thread on the prewinder drums 57.

The detectors 48 and 49 are preferably eye-shaped motion detectors, which also form a guide for the threads as these leave the prewinder drums 57.

The weft detector 56 consists of a series of motion detectors, of which two, 61 and 62 respectively, are used by the weft threads 15 and 16. These detectors supply a signal which is a function of the motion of the threads 15 and 16. The guide bar 63 ensures that the weft threads remain in permanent contact with the side walls of the motion detectors.

Finally, also shown schematically in FIG. 3 are the brush brakes 64 which operate on the winding drums 57, since as explained below these can also be of importance.

Depending on how the abovementioned components are connected to the control unit 28 and the monitoring device 29, a supply 1 according to the invention can be accomplished in various ways.

Clearly, in the practical embodiment, the thread detectors 27, 43, 44 and 45 mentionded in FIG. 2 can also consist of the detectors 46, 47 shown in FIG. 3 or the turn detectors 60. The turn detector 60 can be single or double. In the latter case, this means that there is a minimum as well as a maximum detector The turn detector 60 is able to determine the quantity of the thread on the prewinder, which in turn determines the length of the delay after which the weaving machine must be stopped after a thread break.

In order to set one or more limits G, one or more detectors 60, 48, 49 and 61, 62 operate with the monitoring device 29.

Some of the possible variants of the practical arrangement shown in FIG. 3 are now described with reference to the schematic diagrams in FIGS. 4 to 9. The embodiments shown all relate to the abovementioned thread preparation mechanism 2.

In each of the embodiments shown in FIGS. 4 to 9, the abovementioned detector 46 mounted in front of the winding tube 58 is used as the thread break detector 27 connected to the control unit 28.

Figure 4:
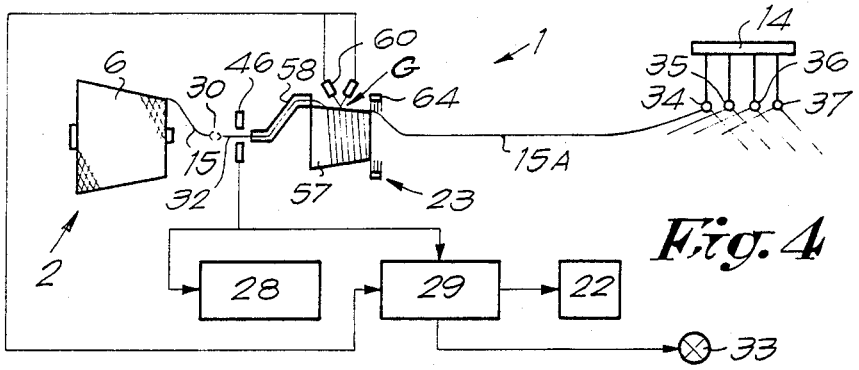
FIGS. 4 to 9 are schematic diagrams of various possible variants of the embodiment shown in FIG. 3.
Figure 5:
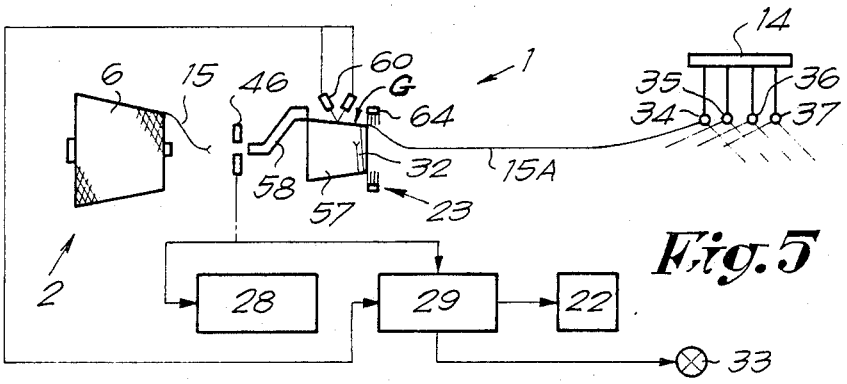

As shown in FIGS. 4 and 5 the monitoring device 29 consists of a connection between the turn detector 60 and the main drive 22 of the weaving machine. The abovementioned limit G in this case is formed by the point at which the turn detector 60 is located. The thread braking device 23 shown schematically in FIG. 2 is in this practical example formed by the brush brake 64.

The operation of the supply 1 operates as follows: as shown in FIG. 4, whenever a break 30 is detected by the detector 46, the control unit 28 and the monitoring device 29 are activated. The control unit 28 ensures that operation is switched to one of the other thread preparation mechanisms 3, 4 or 5 or that, if these thread preparation mechanisms are already in use, they continue to operate according to a preset pattern in such a way that they take over the task of the deactivated mechanism 2. The alarm signalling device 33 can then be activated at that moment, either by the monitoring device 29 or perhaps directly by the detector 46, so that the weaver is alerted to the fact that a break 30 has occurred. Since the cloth 19 moves on, the weft thread 15 is also slowly unwound farther. Once the monitoring device 29, or in this case the turn detector 60 connected to it, does not detect a thread any more, the main drive 22 of the weaving machine is inexorably shut down, whereupon for example a lamp of another color lights up on the alarm signalling device 33. Stopping the weaving machine in good time in this way prevents the broken section of weft thread 15A being inserted into the shed.

FIG. 5 shows another variant. Here, the monitoring device 29 includes a connection between the turn detectors 60 and the main drive 22 of the weaving machine and/or the alarm signalling device 33. The particular feature of this variant is that the monitoring device 29 has a delay circuit and/or an arithmetic unit, such that, from the moment that thread is no longer detected at the turn detector 60, the main drive 22 of the weaving machine can remain in operation for a short while longer. Since there are still a number of turns on the prewinder drum 57, some thread can still be drawn from the prewinder drum 57 for a short while before the thread comes away from the brush brake 64. The length of the interval during which the section of weft thread 15A can continue to move without coming loose from the brush brake 64 can be calculated as a function of the speed at which the cloth 19 moves along, which in turn is a function of the beat-up frequency of the reed and the pick density. When the preset limit G is reached, the main drive of the weaving machine is shut off, and this is made known by a suitable visible signal on the alarm signalling device 33.

Figure 6:
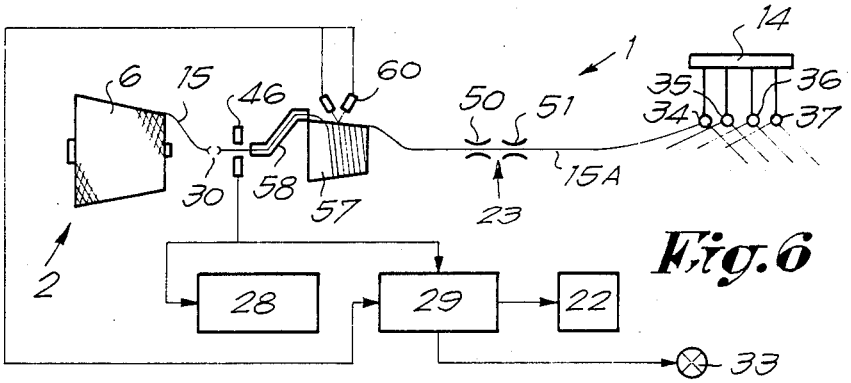

In the embodiment shown in FIG. 6, the abovementioned thread braking device 23 includes the thread brakes 50 and 51 instead of the brush brake 64. For the rest, the operation is similar to that of the embodiments shown in FIGS. 4 and 5.

Figure 7:
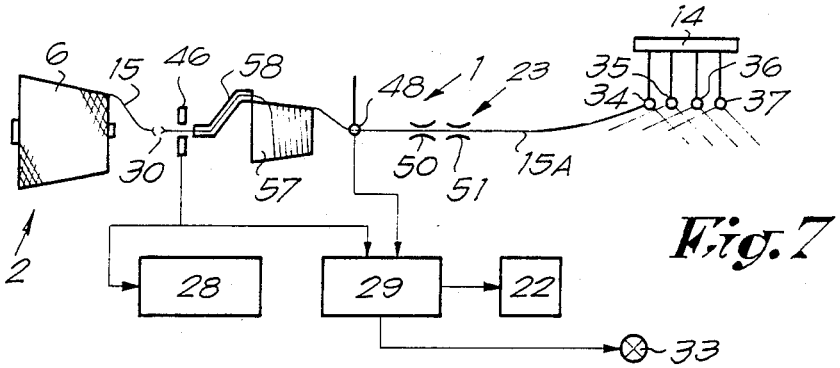

In the embodiment shown in FIG. 7, the monitoring device 29 includes connections between the abovementioned thread detector 48 and the alarm signalling device 33 and the main drive 22 of the weaving machine respectively. The thread braking mechanism is formed by the thread brakes 50 and 51. The operation is similar to that of the embodiments previously described; in other words, when detector 46 detects a break 30, the alarm signalling device 33 is activated, and when detector 48 does not detect a thread any more the main drive 22 of the weaving machine is shut off, so that the broken section of weft thread 15A remains held in the thread brakes 50 and 51. The use of the two thread brakes 50 and 51 offers a greater degree of certainty that the section of weft thread 15A will be held fast.

Clearly, the detector 48 can consist of either a conventional thread detector or a motion detector. The former will detect the presence or absence of a thread, while the latter will detect whether or not the thread is moving.

Figure 8:
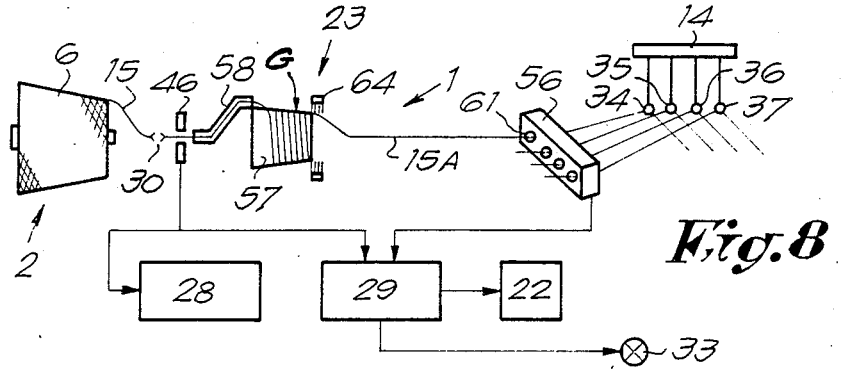
Figure 9:
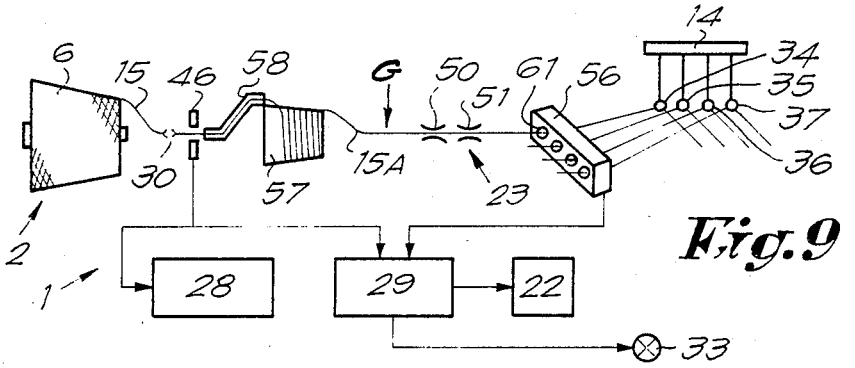

FIGS. 8 and 9 show another two variants in which use is made of the weft detector 56. The monitoring device 29 in this case consists of connections from the detector 46 and from the weft detector 56 to the alarm signalling device 33 and/or the main drive 22 of the weaving machine. In this case, the monitoring device 29 includes an arithmetic unit which can calculate how much weft thread 15 has passed the motion detector 61, as a function of the signal from the weft detector 56.

The operation is as follows. When the detector 46 does not detect a thread any more, the control unit 28 and the monitoring device 29 are activated. By means of the control unit 28, operation is switched to the other thread preparation mechanisms, or the thread preparation mechanisms in use take over the task of the deactivated mechanism. The broken section of weft thread 15A however continues to advance, since it is attached to the edge of the cloth 19.

Depending on the minimum length of the weft thread between the detector 46 and the thread braking element 23, for example the brush brake 64, from the moment at which no thread is detected any more at the detector 46 because it is pulled along by the cloth, the main drive 22 of the weaving machine is stopped in good time such that the broken section of weft thread 15A is not pulled out of the corresponding thread braking device 23.

FIG. 9 shows a variant of FIG. 8 in which the thread braking device is formed by the thread brakes 50 and 51.

Clearly, a combination of the possibilities described above can be used. For example, in the thread preparation mechanism 2 in FIG. 3 the monitoring device 29 consists of connections from the detectors 46, 60 and 48 to the alarm signalling device 33 and the main drive 22 of the weaving machine. When detector 46 does not detect a thread any more, then for example a flashing light on the alarm signalling device 33 can be activated. When the turn detector 60 does not detect a thread any more, this light can flash faster, and when the detector 48 does not detect anything any more, it can shine continuously.

After that moment, depending on the amount by which the cloth 19 advances, after a certain amount of time or, since the pick density is known, after a certain number of picks, the main drive of the weaving machine is shut off before the free end 32 reaches the thread brakes 50 and 51, by means of an arithmetic unit or a delay circuit. Depending on the type of alarm signal given, the weaver knows how urgently a repair has to be carried out in order to prevent a machine stop.

By combining the detector 46 and a time setting, the rate of flashing of the signal lamp 46 can depend on the amount of time that has elapsed.

Clearly, the weaving machine, and more particularly its improved supply, can be made in different forms and variants while still remaining within the scope of the invention.

I claim:

1. A weaving machine of the type in which each weft thread remains attached to the edge of the cloth between successive picks, the weft threads moving along with the cloth as weaving progresses, comprising: at least two thread preparation mechanisms, each of which includes a thread package, a prewinder, and a thread braking device; at least one thread break detector positioned adjacent a path followed by the weft thread from a thread package to a thread braking device; a thread presentation mechanism placed between the thread preparation mechanisms and a shed, and including thread guide elements corresponding to respective thread preparation mechanisms; a control unit connected to the thread preparation mechanisms, the thread presentation mechanism, and the thread break detector, said control unit including means for deactivating both an active thread preparation mechanism and a corresponding thread guide element of the thread presentation mechanism if the thread break detector detects a thread break, after which weaving continues with one or more of the other thread preparation mechanisms and corresponding thread guide elements; and a monitoring device including means for setting a limit to how much a broken section of weft thread still attached to the cloth can move if the thread break detector detects a thread break, and means for supplying an output signal indicative of the moment when said limit is reached.

2. A weaving machine as claimed in claim 1, wherein said weaving machine includes a main drive and the monitoring device is connected to the main drive, said main drive including means responsive to the output signal for stopping the weaving machine when said limit is reached.

3. A weaving machine according to claim 1, wherein the monitoring device is connected to an alarm signaling device arranged to give one or more alarm signals in response to the output signal of the monitoring device.

4. A weaving machine as claimed in claim 1, wherein the monitoring device is connected to both an alarm signaling device and to the main drive of the weaving machine and includes means for activating said alarm signaling device first, and then after a predetermined time interval stopping the weaving machine in response to said output signal.

5. A weaving machine as claimed in claim 1, wherein said prewinder includes a drum and the thread break detector is placed in the path of the corresponding weft thread before the weft thread is wound onto the drum.

6. A weaving machine as claimed in claim 1, wherein the monitoring device includes a connection with a second thread break detector placed along the path followed by the weft thread between the first thread break detector connected to said control unit and the thread braking device, and wherein the monitoring device is arranged to immediately supply the output signal as soon as the second detector does not detect a thread.

7. A weaving machine as claimed in claim 1, wherein the monitoring device includes a second break detector mounted in the path followed by a weft thread upstream of the thread braking device and an arithmetic unit connected to it, said monitoring device, detector, and arithmetic unit including means for supplying at least one output signal for further processing after a time delay which depends on the minimum quantity of weft thread present between said detector and the thread breaking element, and means for supplying at least one output signal after the thread detector does not detect a weft thread but before the free end of the broken section of weft thread has come loose from the thread braking device.

8. A weaving machine as claimed in claims 6 or 7, wherein the second detector is a turn detector of the prewinder of the corresponding weft thread.

9. A weaving machine as claimed in claim 8, wherein the thread braking device includes a brush brake arranged to operate on the prewinder drum.

10. A weaving machine as claimed in claims 6 or 7, wherein the second break detector is positioned downstream of the prewinder drum in respect to the path of the weft thread.

11. A weaving machine as claimed in claim 1, wherein the monitoring device includes a plurality of second break detectors and the thread braking device includes at least one thread brake positioned in the path of the corresponding weft thread downstream of corresponding second detectors, but upstream of the thread presentation mechanism.

12. A weaving machine as claimed in claim 1, wherein the monitoring device includes connections from a plurality of second break detectors to an alarm signaling device and to a main drive of the weaving machine, and wherein the second detectors are arranged such that a number of second detectors provide successive activation of different alarms on the alarm signaling device, while one second detector stops the main drive of the weaving machine at the moment that said limit for the free end of the broken section of weft thread is reached.

* * * * *